US010818272B1

(12) United States Patent
Buehl et al.

(10) Patent No.: US 10,818,272 B1
(45) Date of Patent: Oct. 27, 2020

(54) BRIDGE MONO-SADDLE FOR STRINGED MUSICAL INSTRUMENT

(71) Applicant: Fender Musical Instruments Corporation, Scottsdale, AZ (US)

(72) Inventors: Scott Alan Buehl, Upland, CA (US); Dennis Galuszka, Riverside, CA (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 16/729,045

(22) Filed: Dec. 27, 2019

(51) Int. Cl.
*G10D 3/04* (2020.01)
*G10D 3/13* (2020.01)

(52) U.S. Cl.
CPC ..... *G10D 3/04* (2013.01); *G10D 3/13* (2020.02)

(58) Field of Classification Search
None
See application file for complete search history.

(56) References Cited

U.S. PATENT DOCUMENTS 1,190,929 A * 7/1916 Marx ..... G10D 3/04 84/307
2,737,842 A * 3/1956 Polfuss ..... G10D 3/04 84/299
2,918,837 A * 12/1959 Webster ..... G10D 3/04 84/312 R
2,959,085 A * 11/1960 Porter ..... G10D 3/04 84/314 N
2,972,923 A 2/1961 Fender
3,443,467 A * 5/1969 Richards ..... G10D 3/04 84/307
4,031,799 A * 6/1977 Fender ..... G10D 3/04 84/307
5,481,956 A * 1/1996 LoJacono ..... G10D 3/04 84/314 N
5,750,910 A * 5/1998 LoJacono ..... G10D 3/04 84/314 N
6,143,966 A * 11/2000 Feiten ..... G10D 1/08 84/312 R
7,019,202 B1 * 3/2006 Hetzel ..... G10D 3/04 84/209
8,283,542 B2 * 10/2012 Woodland ..... G10D 3/04 84/411 R
8,816,177 B2 * 8/2014 Goto ..... G10D 3/04 84/307
9,508,327 B2 * 11/2016 Jackson ..... G10D 3/147
(Continued)

*Primary Examiner* — Robert W Horn
(74) *Attorney, Agent, or Firm* — Robert D. Atkins; Patent Law Group: Atkins and Associates, P.C.

(57) ABSTRACT

A bridge saddle assembly for a musical instrument has a channel member with a side rail. A bridge saddle is disposed within the channel member. The bridge saddle has a cylindrical, rectangular, triangular, thin blade, or rounded top and bottom with flat sides shape. A rocker cup is disposed under the channel member to allow the bridge saddle assembly to pivot. The bridge saddle is a homogenous material, such as brass, with a plurality of grooves adapted for receiving a plurality of strings. A bolt is disposed through an opening in the side rail and into a threaded opening in the bridge saddle. A spring is disposed over the bolt between the side rail and the bridge saddle. A tail assembly is mounted to a surface of the musical instrument. A plurality of strings is coupled to the tail assembly and extend through the grooves in the bridge saddle.

20 Claims, 10 Drawing Sheets

(56) References Cited

U.S. PATENT DOCUMENTS

| | | | | |
|---|---|---|---|---|
| 9,799,307 | B1 | 10/2017 | Minasi | |
| 9,922,625 | B2 | 3/2018 | Tracy | |
| 10,229,659 | B2 * | 3/2019 | Lyles | G10D 3/04 |
| 10,446,122 | B2 | 10/2019 | Colas et al. | |
| 2014/0007753 | A1 * | 1/2014 | Erismann | G10D 3/04<br>84/298 |
| 2016/0098976 | A1 * | 4/2016 | Smith | G10D 3/04<br>84/298 |
| 2019/0228745 | A1 * | 7/2019 | Johnston | G10D 1/085 |

* cited by examiner

BRIDGE MONO-SADDLE FOR STRINGED MUSICAL INSTRUMENT

FIELD OF THE INVENTION

The present invention relates in general to stringed musical instruments and, more particularly, to a bridge mono-saddle for a stringed musical instrument.

BACKGROUND OF THE INVENTION

Many musical instruments include strings which the player imparts movement to generate sound. The guitar is a classic stringed musical instrument and comes in a variety of styles and configurations. For acoustic guitars, the string vibration resonates through the body of the guitar to generate sound. In the case of an electric guitar, the audio sound is produced indirectly from the motion of the string, typically steel strings, over a magnetic pickup. The magnetic pickup generates an electrical signal representative of the vibration of the strings. The electrical signal is routed to an audio amplifier to reproduce the original sound.

The strings extend over the guitar body, fret board and bridge, and anchor to a headstock and a tail assembly at opposite ends of the guitar. A stand-alone bridge has issues with sound quality in part because there is minimal down-pressure from the strings to the bridge causing a loss of tone and energy. The strings do not sit well in the grooves of the bridge and can be dislodged by tension during aggressive play.

Guitars are known to use a bridge saddle assembly positioned proximate to the tail assembly to provide further support and pressure on the strings and improve sound quality. When the strings are tightened, there is more tension on the bridge saddle assembly. However, most designs have independent saddles for each string, which are difficult to tune and maintain in a playable state. There remains a need to improve the overall sound quality from a guitar with a bridge saddle.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
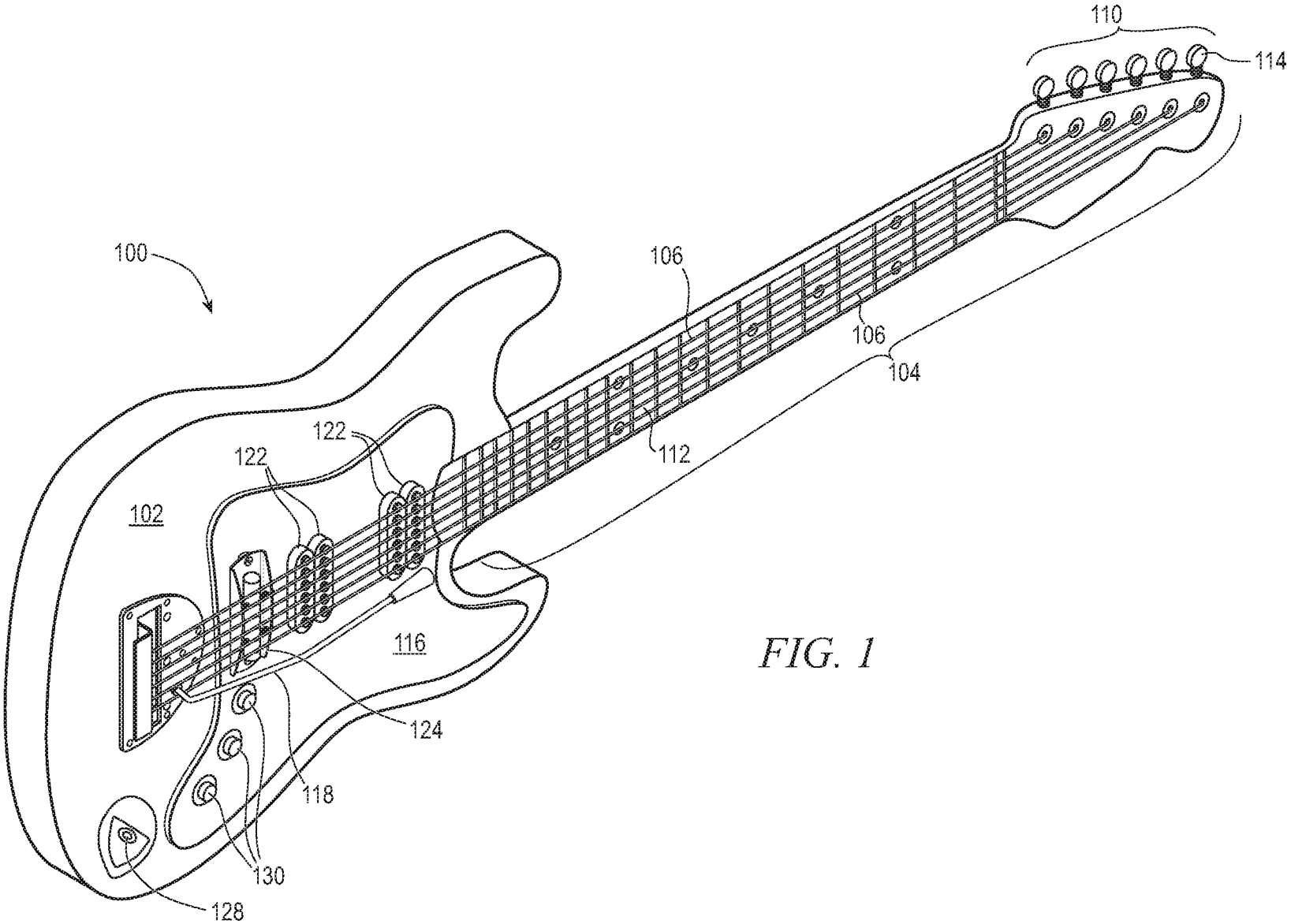
FIG. 1 illustrates a guitar with a bridge mono-saddle assembly.

FIG. 1 illustrates guitar 100 including body 102, neck 104, and strings 106. Guitar 100 can be an acoustic guitar, electric guitar, electric bass guitar, or any other string musical instrument. A tail assembly 108 is affixed to body 102 using adhesive, screws, clips, or other suitable attachment mechanism. Tail assembly 108 anchors and supports one end of strings 106. Neck 104 includes headstock 110 and fretboard 112. Machine heads 114 are attached to headstock 110 and anchor an opposite end of strings 106. The tension of strings 106 can be adjusted and guitar 100 is tuned in part by turning machine heads 114. A pickguard or scratch plate 116 is attached to body 102. The movement of tremolo arm 118 makes mechanical adjustments to tail assembly 108 to modulate the tone of strings 106.

Strings 106 are routed from headstock 110 over fret board 112, magnetic pickup 122, and bridge saddle assembly 124 to tail assembly 108. Magnetic pickup 122 is mounted to body 102 using adhesive, screws, clips, or other suitable attachment mechanism. Magnetic pickup 122 is disposed under strings 106 to convert string movement to electrical signals representative of the intended sounds from the vibrating strings. An audio output jack 128 is provided on body 102. The electrical signals generated by magnetic pickup 122 are output from guitar 100 through audio output jack 128. The audio signals and control signals are routed from audio output jack 128 to external devices, e.g., an amplifier and speaker, for signal conditioning and amplification and sound reproduction. Control knobs 130 adjust sound properties, such as volume, bass, and treble.

Figure 2:
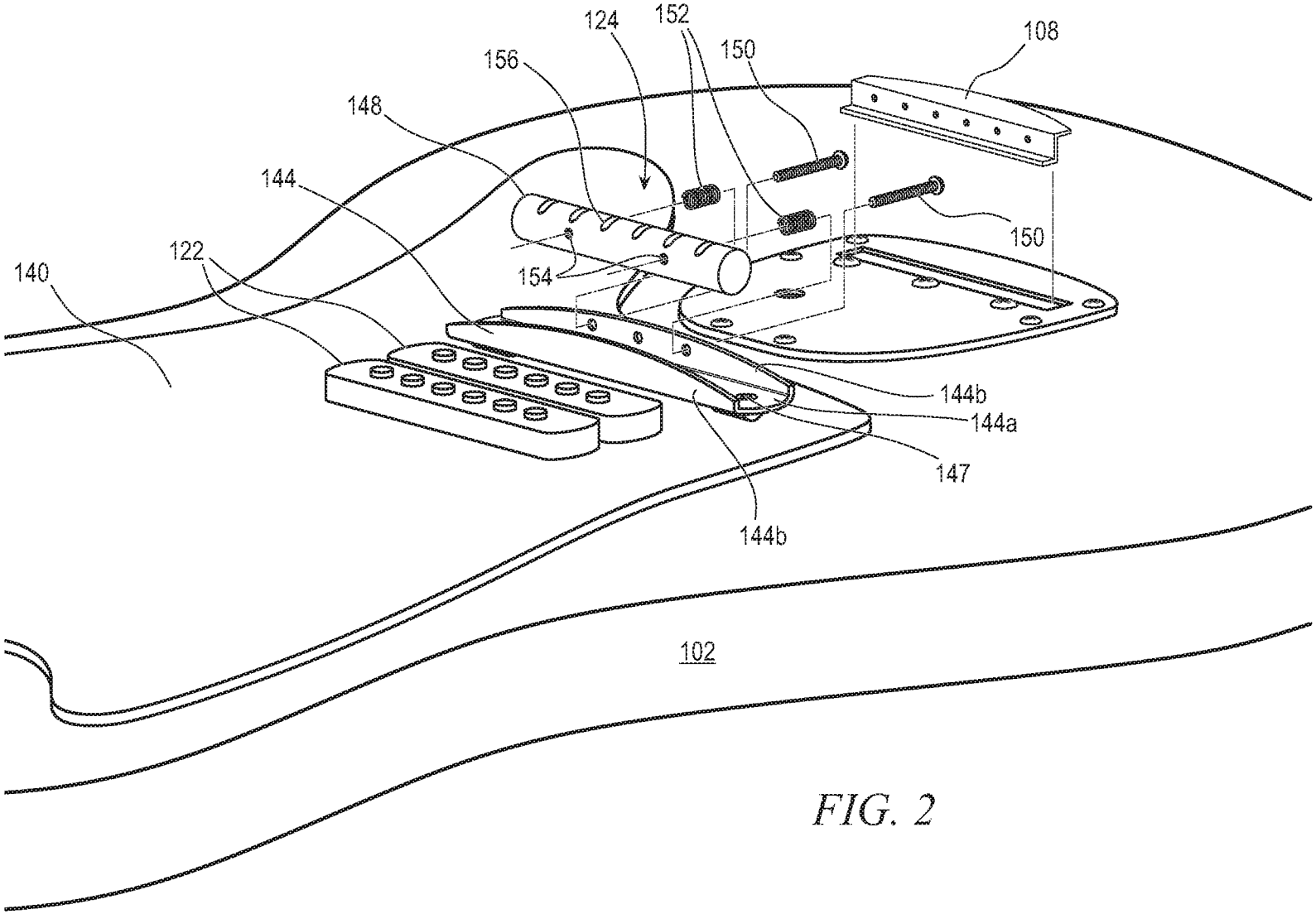
FIG. 2 illustrates further detail of the bridge mono-saddle assembly with respect to the guitar.

In FIG. 2, tail assembly 108, magnetic pickup 122, and bridge saddle assembly 124 are mounted to surface 140 of body 102. In particular, bridge saddle assembly 124 includes channel member 144 with rocker assembly, see FIG. 5, to allow the bridge assembly to rock or pivot back and forth in the direction along length of strings 106 in response to tremolo arm 118 movement of tail assembly 108, causing the strings to shorten or lengthen to change tonal properties. Channel member 144 includes a flat bottom portion 144*a* and side rails 144*b* perpendicular to the flat bottom portion. Screws or rivets 147 secure channel member 144 to surface 140. Bridge saddle 148 is positioned within channel member 144 and held in place with bolts 150 under tension of springs 152. Bolts 150 extend through side rails 144*b* and threaded openings 154 in bridge saddle 148. Bridge saddle 148 includes grooves or slots 156 designated for strings 106. In one embodiment, grooves 156 have a depth of 1.6 millimeters (mm) to encompass strings 106, with a peak in the center of the groove to intonate the string.

Figure 3:
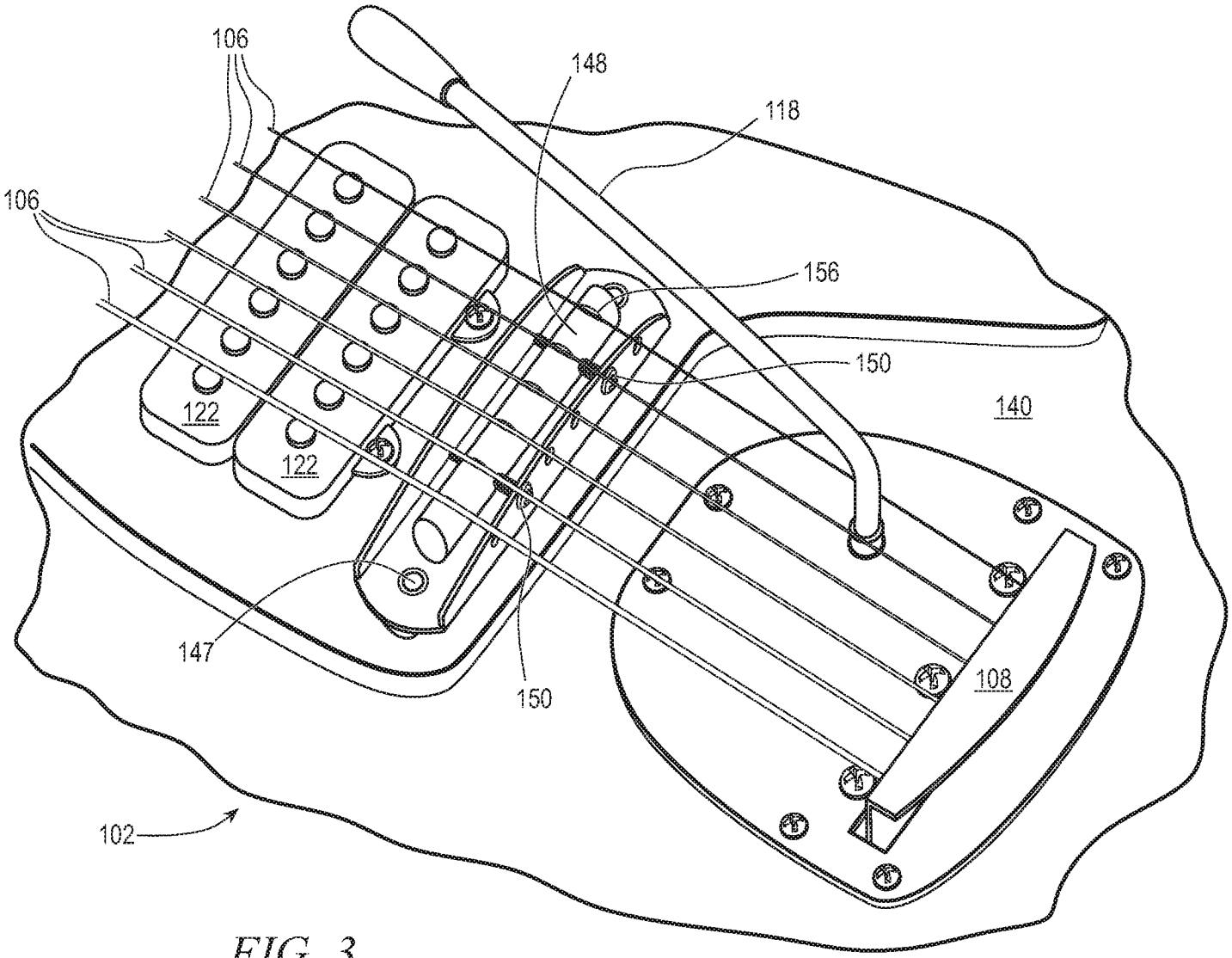
FIG. 3 illustrates the bridge mono-saddle assembly mounted to the guitar.

FIG. 3 shows bridge saddle assembly 124 mounted to surface 140 of body 102. Bridge saddle 148 is held in place within channel member 144 by bolts 150 under tension of springs 152. Bolts 150 extend through side rails 144*b* and threaded openings 154 in bridge saddle 148. The length of bridge saddle 148 is less than the length of channel member 144 to provide access for screws or rivets 147. Strings 106 are routed over magnetic pickup 122 and through grooves 156 of bridge saddle 148 to tail assembly 108.

Figure 4:
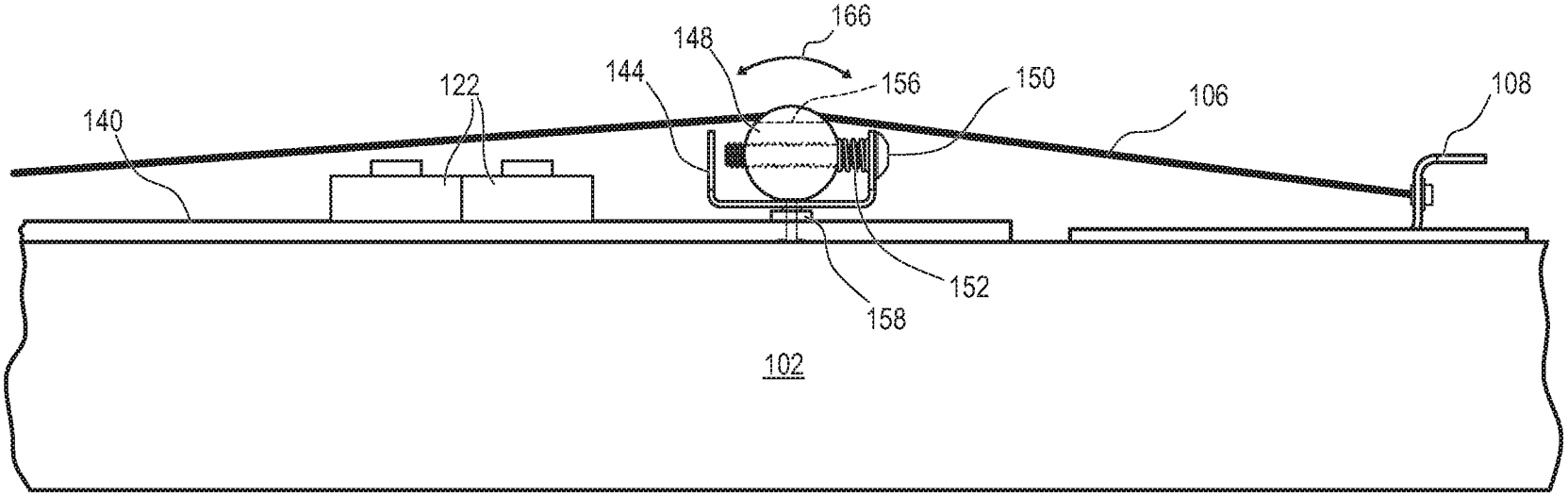
FIG. 4 illustrates a side view of the bridge mono-saddle assembly mounted to the guitar.
Figure 5:
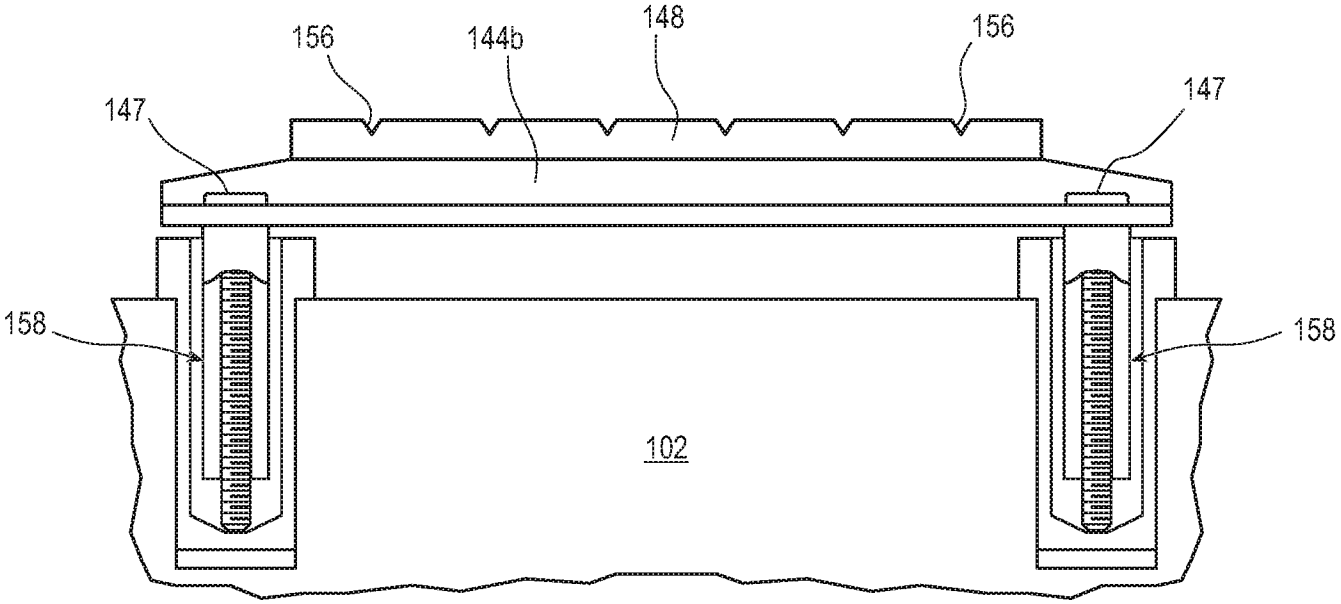
FIG. 5 illustrates the rocker assembly for the bridge mono-saddle.

FIG. 4 shows a side view of bridge saddle assembly 124 mounted to surface 140 of body 102. FIG. 5 shows rocker assemblies 158 which allow bridge saddle assembly 124 to rock or pivot back and forth along arc 166 in response to the movement of tremolo arm 118 acting on tail assembly 108. Rocker assembly 158 is described in U.S. Pat. No. 2,972,923, which is incorporated herein by reference.

Figure 6D:
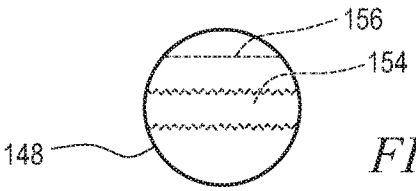
FIGS. 6*a*-6*d* illustrate further detail of the bridge mono-saddle.
Figure 6B:
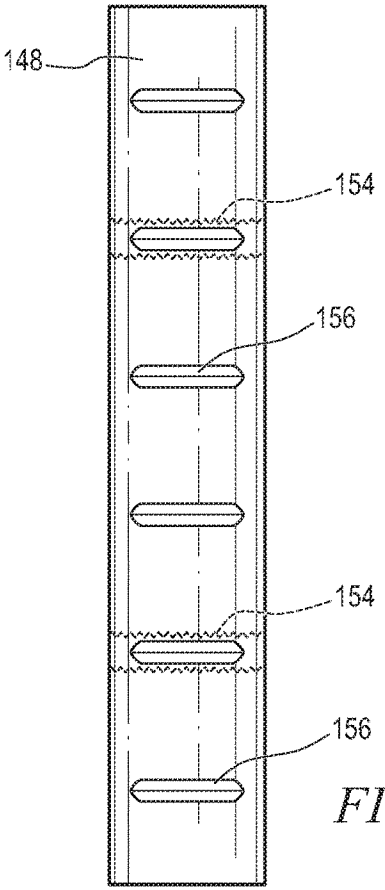
Figure 6A:
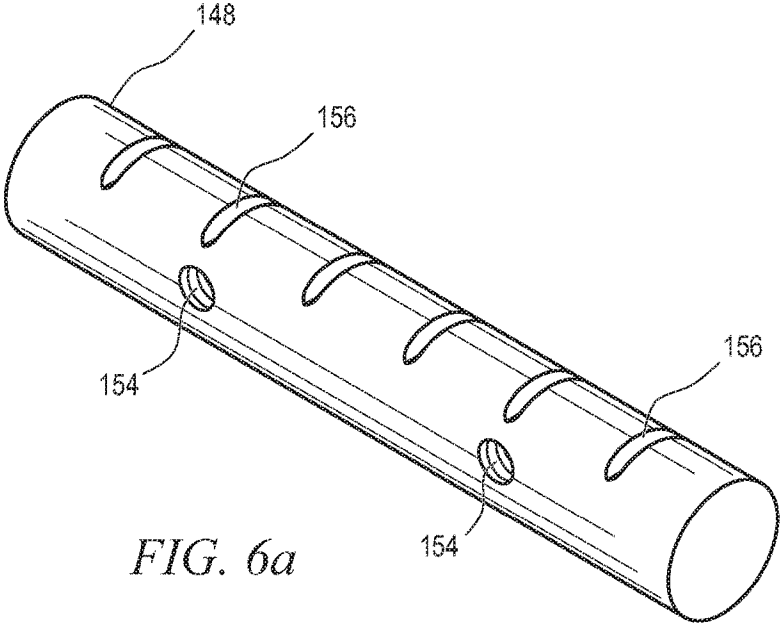
Figure 6C:
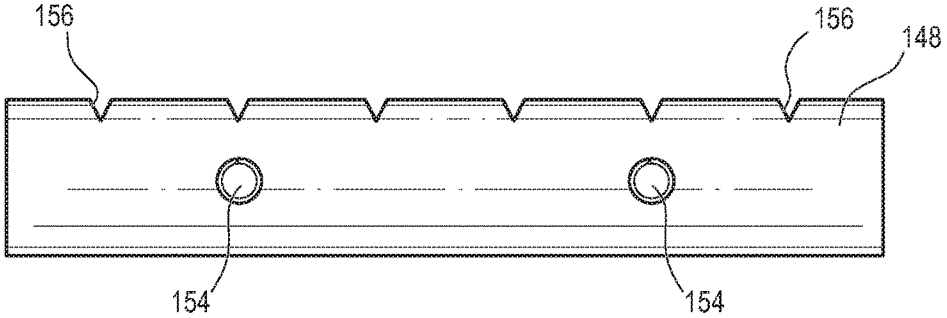

FIGS. 6*a*-6*d* show further detail of bridge saddle 148. FIG. 6*a* is a perspective view of bridge saddle 148 with grooves 156. Bridge saddle 148 is a single (mono) solid homogenous cylindrical metal bar made of brass, copper, aluminum, hardened polymer, or other similar material. FIG. 6*b* is a top view of bridge mono-saddle 148 with grooves 156. FIG. 6*c* is a side view of bridge mono-saddle 148 with grooves 156. FIG. 6*d* is an end view of bridge mono-saddle 148 with grooves 156.

Figure 7D:
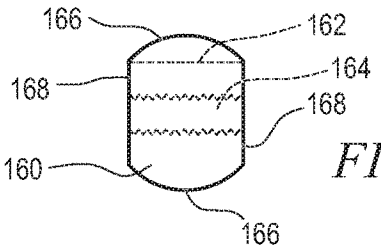
FIGS. 7*a*-7*d* illustrate another embodiment of the bridge mono-saddle with rounded top and bottom surfaces and flat sides.
Figure 7B:
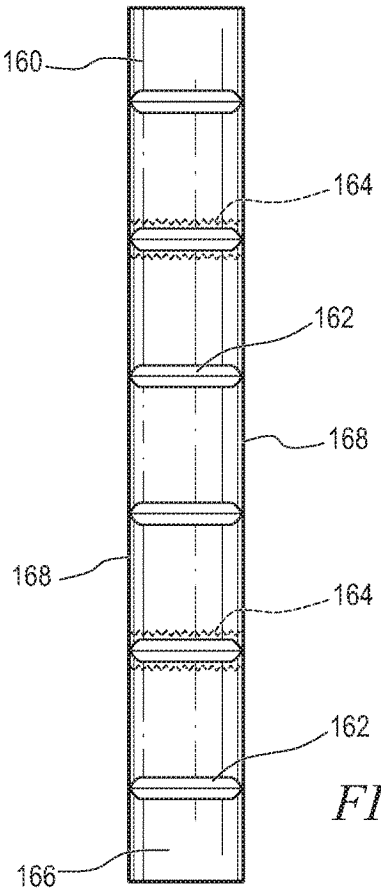
Figure 7A:
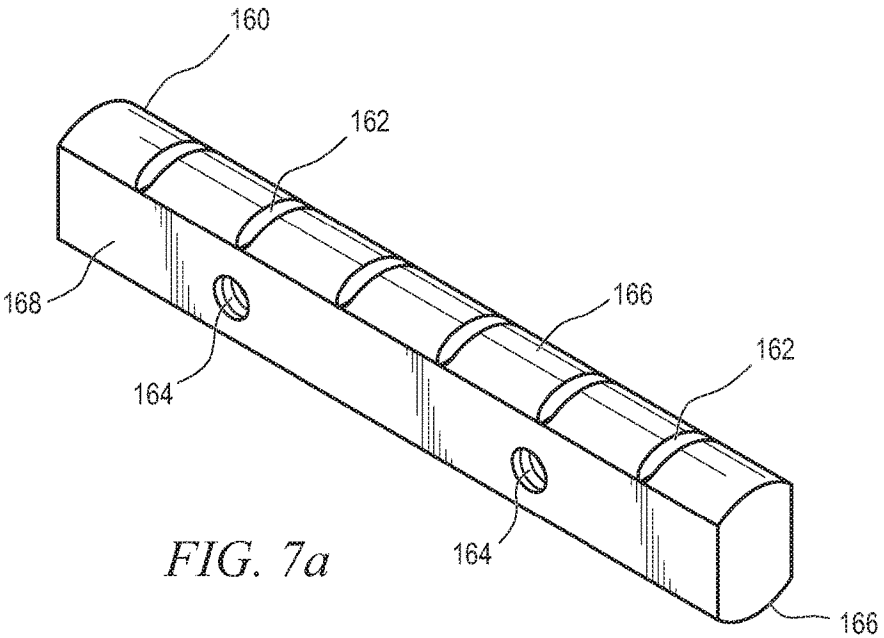
Figure 7C:
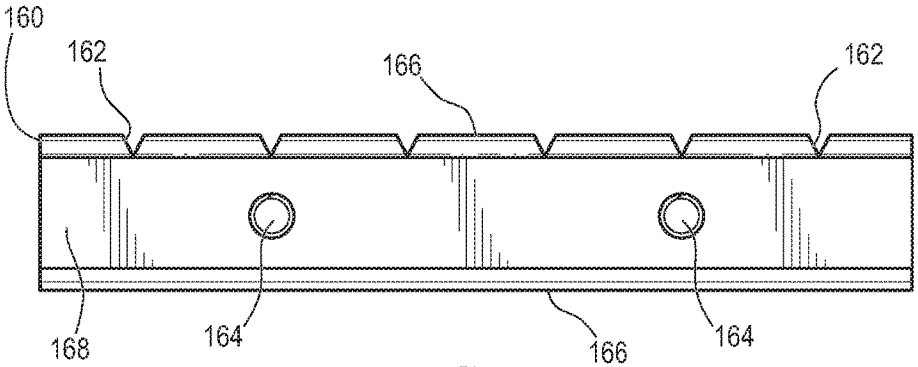

FIGS. 7*a*-7*d* show another embodiment of the bridge saddle. FIG. 7*a* is a perspective view of bridge saddle 160 with grooves 162 and threaded openings 164. Bridge saddle 160 is a single (mono) solid homogenous metal bar made of brass, copper, aluminum, hardened polymer, or other similar material. Bridge saddle 160 has rounded top and bottom surfaces 166 and flat side surfaces 168. FIG. 7*b* is a top view of bridge mono-saddle 160 with grooves 162. FIG. 7*c* is a side view of bridge mono-saddle 160 with grooves 162. FIG. 7*d* is an end view of bridge mono-saddle 160 with grooves 162.

Figure 8D:
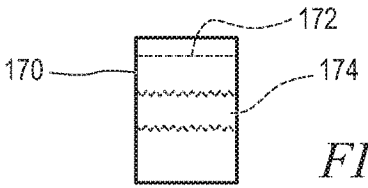
FIGS. 8*a*-8*d* illustrate another embodiment of the bridge mono-saddle with a rectangular or square cross-section.
Figure 8B:
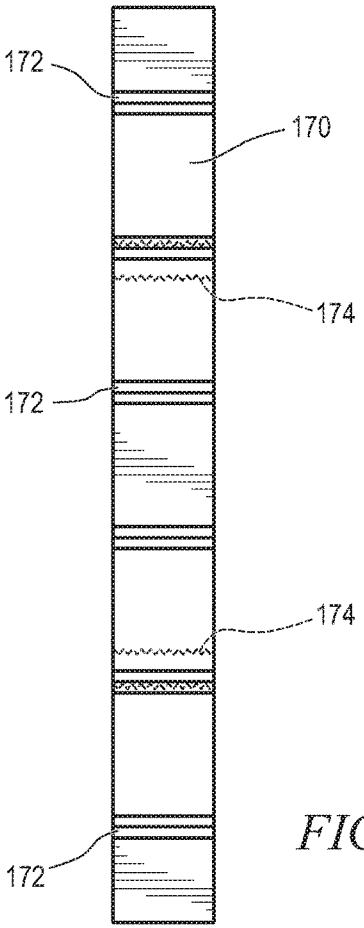
Figure 8A:
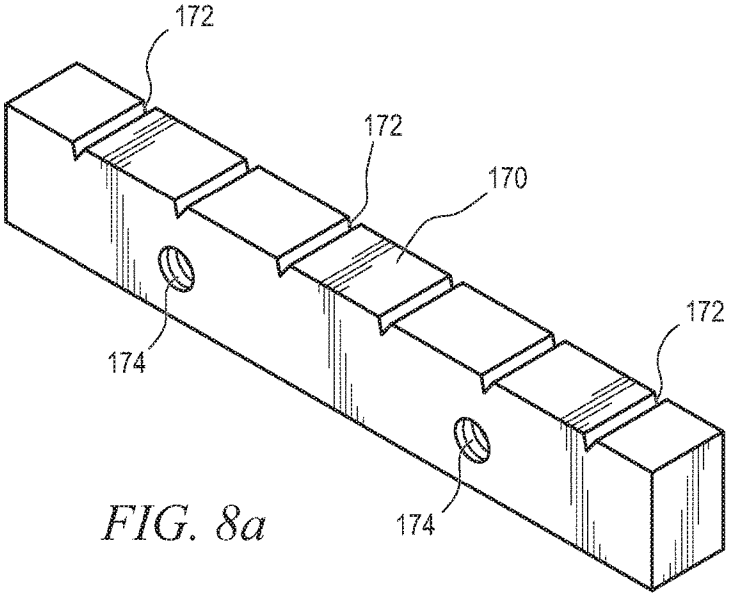
Figure 8C:
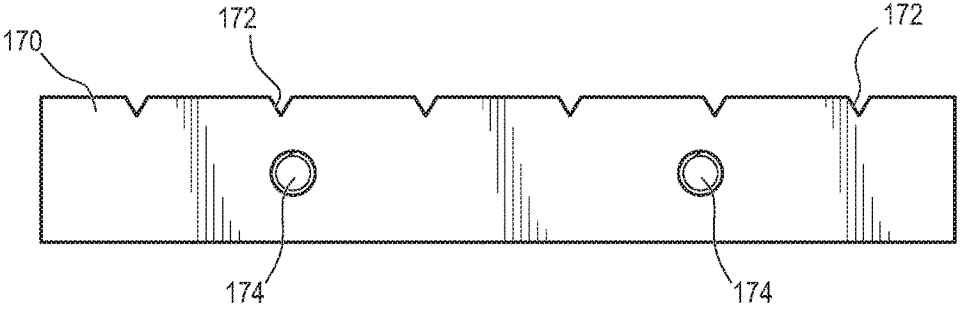

FIGS. 8*a*-8*d* show another embodiment of the bridge saddle. FIG. 8*a* is a perspective view of bridge saddle 170 with grooves 172 and threaded openings 174. Bridge saddle 170 is a single (mono) solid homogenous metal bar made of brass, copper, aluminum, hardened polymer, or other similar material. Bridge saddle 170 is rectangular or square in cross-section. FIG. 8*b* is a top view of bridge mono-saddle 170 with grooves 172. FIG. 8*c* is a side view of bridge mono-saddle 170 with grooves 172. FIG. 8*d* is an end view of bridge mono-saddle 170 with grooves 172.

Figure 9D:
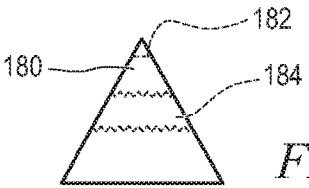
FIGS. 9*a*-9*d* illustrate another embodiment of the bridge mono-saddle with a triangular cross-section.
Figure 9B:
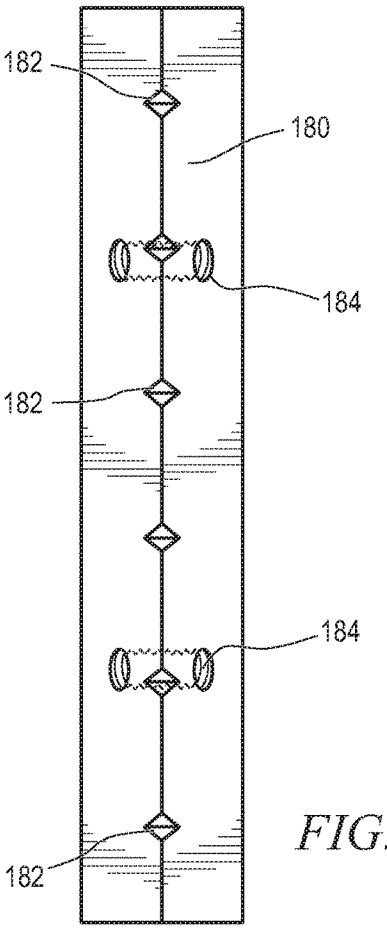
Figure 9A:
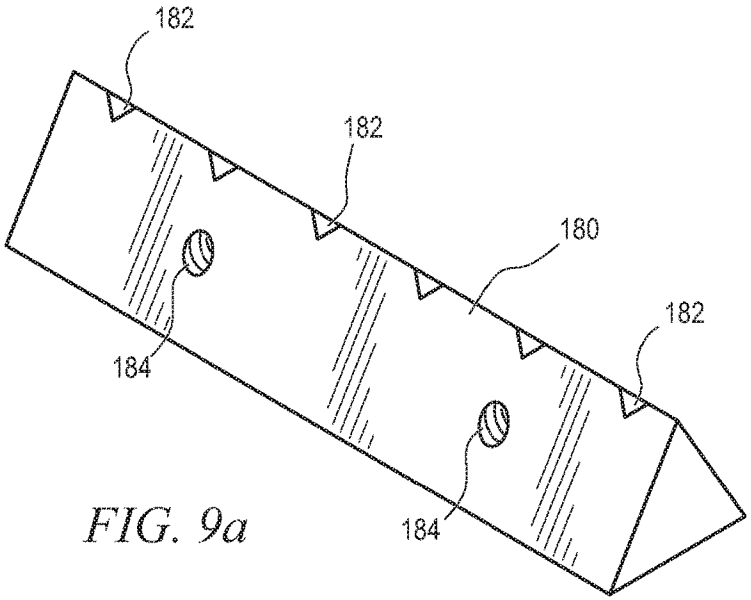
Figure 9C:
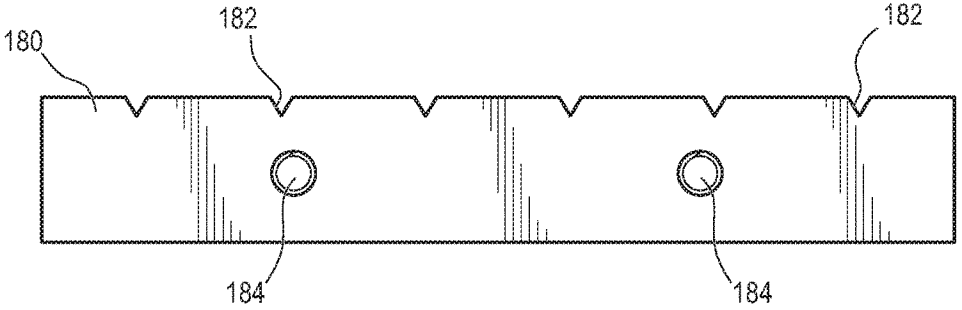

FIGS. 9*a*-9*d* show another embodiment of the bridge saddle. FIG. 9*a* is a perspective view of bridge saddle 180 with grooves 182 and threaded openings 184. Bridge saddle 180 is a single (mono) solid homogenous metal bar made of brass, copper, aluminum, hardened polymer, or other similar material. Bridge saddle 180 is triangular in cross-section. FIG. 9*b* is a top view of bridge mono-saddle 180 with grooves 182. FIG. 9*c* is a side view of bridge mono-saddle 180 with grooves 182. FIG. 9*d* is an end view of bridge mono-saddle 180 with grooves 182.

Figure 10D:
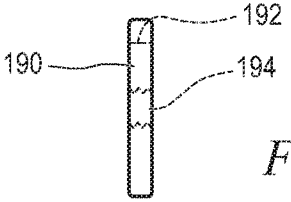
FIGS. 10*a*-10*d* illustrate another embodiment of the bridge mono-saddle with a thin blade cross-section.
Figure 10B:
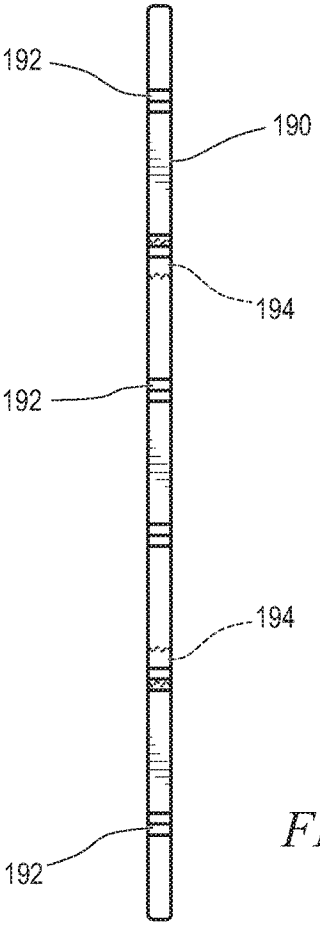
Figure 10A:
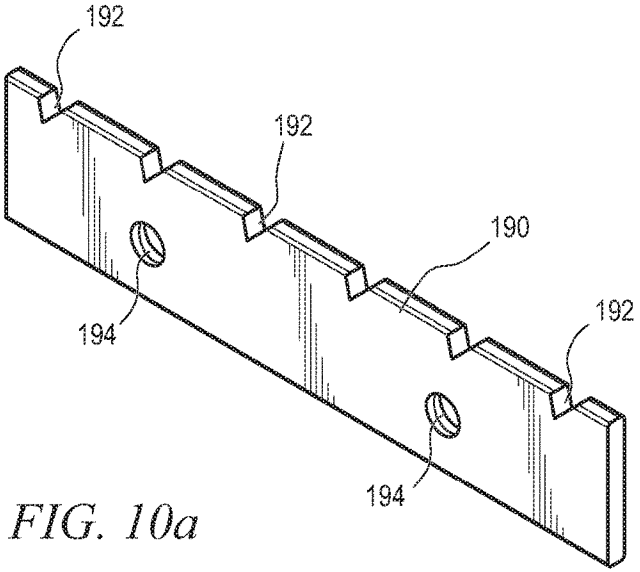
Figure 10C:
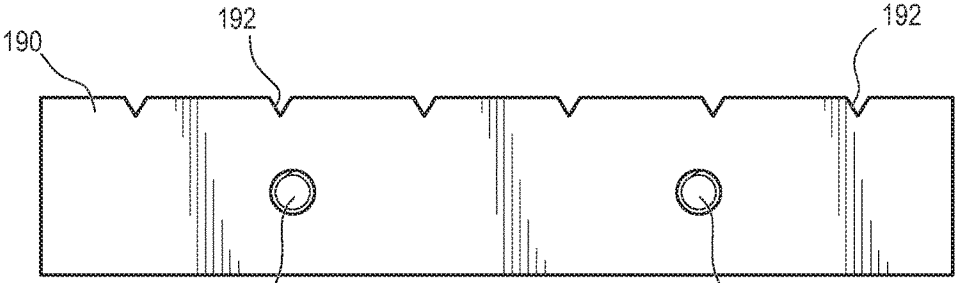

FIGS. 10*a*-10*d* show another embodiment of the bridge saddle. FIG. 10*a* is a perspective view of bridge saddle 190 with grooves 192 and threaded openings 194. Bridge saddle 190 is a single (mono) solid homogenous metal bar made of brass, copper, aluminum, hardened polymer, or other similar material. Bridge saddle 190 is a thin blade in cross-section. FIG. 10*b* is a top view of bridge mono-saddle 190 with grooves 192. FIG. 10*c* is a side view of bridge mono-saddle 190 with grooves 192. FIG. 10*d* is an end view of bridge mono-saddle 190 with grooves 192.

In summary, guitar 100 uses a rocking tail assembly 108 with a single intonated bridge mono-saddle 148 to improve tonal properties over individual saddles. The intonation of mono-saddle 148 from the higher down pressure substantially improves tonal properties of guitar 100. Bridge saddle assembly 124 is also easy to install and with a lower cost.

While one or more embodiments of the present invention have been illustrated in detail, the skilled artisan will appreciate that modifications and adaptations to those embodiments may be made without departing from the scope of the present invention as set forth in the following claims.

What is claimed:

1. A bridge saddle assembly for a musical instrument, comprising:

a channel member including a side rail;

a bridge saddle disposed within the channel member, wherein the bridge saddle is a homogenous material with a plurality of grooves adapted for receiving a plurality of strings respectively; and a bolt disposed through an opening in the side rail and into an opening in the bridge saddle.

2. The bridge saddle assembly of claim 1, wherein the homogenous material includes brass, copper, aluminum, or hardened polymer.

3. The bridge saddle assembly of claim 1, further including a spring disposed around the bolt between the side rail and the bridge saddle.

4. The bridge saddle assembly of claim 1, further including a rocker cup disposed under the channel member.

5. The bridge saddle assembly of claim 1, wherein a shape of the bridge saddle includes a cylindrical, rectangular, triangular, thin blade, or rounded top and bottom surfaces with flat side surfaces.

6. The bridge saddle assembly of claim 1, wherein the opening through the bridge saddle is threaded to receive the bolt.

7. In a musical instrument, a bridge saddle assembly, comprising:

a channel member including a side rail;

a bridge saddle disposed within the channel member, wherein the bridge saddle is a homogenous material; and a bolt disposed through an opening in the side rail and into an opening in the bridge saddle.

8. The musical instrument of claim 7, wherein the homogenous material includes brass, copper, aluminum, or hardened polymer.

9. The musical instrument of claim 7, further including a spring disposed around the bolt between the side rail and the bridge saddle.

10. The musical instrument of claim 7, further including a rocker cup disposed under the channel member.

11. The musical instrument of claim 7, wherein a shape of the bridge saddle includes a cylindrical, rectangular, triangular, thin blade, or rounded top and bottom surfaces with flat side surfaces.

12. The musical instrument of claim 7, further including:

a tail assembly mounted to a surface of the musical instrument; and a plurality of strings coupled to the tail assembly and extending through a plurality of grooves in the bridge saddle.

13. The musical instrument of claim 7, wherein the opening through the bridge saddle is threaded to receive the bolt.

14. A method of making a bridge saddle assembly for a musical instrument, comprising:

providing a channel member including a side rail;

disposing a bridge saddle within the channel member, wherein the bridge saddle is a homogenous material; and disposing a bolt through an opening in the side rail and into an opening in the bridge saddle.

15. The method of claim 14, wherein the homogenous material includes brass, copper, aluminum, or hardened polymer.

16. The method of claim 14, further including disposing a spring around the bolt between the side rail and the bridge saddle.

17. The method of claim 14, further including disposing a rocker cup under the channel member.

18. The method of claim 14, wherein a shape of the bridge saddle includes a cylindrical, rectangular, triangular, thin blade, or rounded top and bottom surfaces with flat side surfaces.

19. The method of claim 14, further including:

providing a tail assembly mounted to a surface of the musical instrument; and providing a plurality of strings coupled to the tail assembly and extending through a plurality of grooves in the bridge saddle.

20. The method of claim 14, wherein the opening through the bridge saddle is threaded to receive the bolt.

* * * * *